US006887284B2

(12) United States Patent
Hudson

(10) Patent No.: US 6,887,284 B2
(45) Date of Patent: May 3, 2005

(54) DUAL HOMOGENIZATION SYSTEM AND PROCESS FOR FUEL OIL

(76) Inventor: Dannie B. Hudson, 100 A Timberlane Dr., Summerville, SC (US) 29485

( * ) Notice: Subject to any disclaimer, the term of this patent is extended or adjusted under 35 U.S.C. 154(b) by 488 days.

(21) Appl. No.: 10/194,794

(22) Filed: Jul. 12, 2002

(65) Prior Publication Data

US 2004/0006911 A1 Jan. 15, 2004

(51) Int. Cl.[7] ..... C10L 5/00

(52) U.S. Cl. ..... 44/629; 44/639; 60/39.01; 366/132; 366/136; 366/176.1; 366/176.2

(58) Field of Search ..... 44/629, 639; 60/39.01; 366/132, 136, 176.1, 176.2

(56) References Cited

U.S. PATENT DOCUMENTS

| | | | | |
|---|---|---|---|---|
| 4,268,488 | A | | 5/1981 | Ginger |
| 4,493,558 | A | | 1/1985 | Hudson |
| 4,506,991 | A | | 3/1985 | Hudson |
| 4,928,635 | A | * | 5/1990 | Shelor ..... 122/7 R |
| 4,997,631 | A | | 3/1991 | Hofmann et al. |
| 5,021,227 | A | | 6/1991 | Kobayashi et al. |
| 5,132,103 | A | | 7/1992 | Schoubye |
| 5,139,754 | A | | 8/1992 | Luftglass et al. |
| 5,240,688 | A | | 8/1993 | von Harpe et al. |
| 5,260,042 | A | | 11/1993 | Martin |
| 5,266,083 | A | | 11/1993 | Peter-Hoblyn et al. |
| 5,277,135 | A | | 1/1994 | Dubin et al. |
| 5,281,403 | A | | 1/1994 | Jones |
| 5,431,893 | A | | 7/1995 | Hug et al. |
| 5,466,064 | A | | 11/1995 | Hudson |
| 5,511,582 | A | | 4/1996 | Hudson |
| 5,540,047 | A | | 7/1996 | Dahlheim et al. |
| 5,628,186 | A | | 5/1997 | Schmelz |
| 5,809,774 | A | | 9/1998 | Peter-Hoblyn et al. |
| 5,809,775 | A | | 9/1998 | Tarabulski et al. |
| 5,819,529 | A | | 10/1998 | Peter-Hoblyn |
| 5,924,280 | A | | 7/1999 | Tarabulski |
| 5,968,464 | A | | 10/1999 | Peter-Hoblyn et al. |
| 5,976,475 | A | | 11/1999 | Peter-Hoblyn et al. |
| 6,003,303 | A | | 12/1999 | Peter-Hoblyn et al. |
| 6,023,928 | A | | 2/2000 | Peter-Hoblyn et al. |
| 6,051,040 | A | | 4/2000 | Peter-Hoblyn |
| 6,063,350 | A | | 5/2000 | Tarabulski et al. |
| 6,124,130 | A | | 9/2000 | Olson |
| 6,203,770 | B1 | | 3/2001 | Peter-Hoblyn et al. |
| 6,279,603 | B1 | | 8/2001 | Czarnik et al. |
| 6,361,754 | B1 | | 3/2002 | Peter-Hoblyn et al. |

* cited by examiner

*Primary Examiner*—Cephia D. Toomer
(74) *Attorney, Agent, or Firm*—Dority & Manning, P.A.

(57) ABSTRACT

A system and process for improving the combustion of fuel oil in boilers employs: (1) dual homogenization of fuel oil and water; (2) recovery of heat from, and injection of, boiler waste water in the homogenization system; (3) mixing of urea and boiler waste water and injection into the boiler exhaust gases. The system of the invention includes:

(a) a fuel service subsystem (11) with a boiler (36);

(b) a dual subsystem (13) for homogeneously intermixing boiler waste water and fuel oil, the dual homogenization subsystem (13) including substantially similar primary and secondary homogenization subsystems, each of which includes at least one low pressure homogenization chamber (75, 18) preceding at least one high pressure homogenization subsystem (83, 27), with a compensating valve (74, 82, 17, 26) preceding each homogenization chamber for inducing cavitation;

(c) a boiler blow down water and heat recovery subsystem (12); and (d) a urea and waste water mixing and injection subsystem (14);

wherein the fuel service subsystem (11) leads to the dual homogenization subsystem (13), boiler blow down water from the boiler blow down water and heat recovery subsystem (12) empties into the dual homogenization subsystem (13), and urea and wastewater from the urea and waste water mixing and injection subsystem (14) flow into the boiler exhaust gas stream (66).

17 Claims, 4 Drawing Sheets

DUAL HOMOGENIZATION SYSTEM AND PROCESS FOR FUEL OIL

BACKGROUND OF THE INVENTION

1. Technical Field

This invention relates to the area of fuel homogenization systems and processes, more particularly, to a dual homogenization system and a process for homogenizing fuel oil or recycled oil.

2. Background Information

It is known that cavitation may be employed to emulsify fuel oil and water for use in boilers, internal combustion engines, and turbines. However, cavitation has largely been avoided until now because of precise control needed to operate such a process and because of adverse side effects, including suspected damage to equipment in which it is employed. In the present process, cavitation is used to emulsify and homogenize oil and water and reduce droplet size to achieve more complete combustion without these heretofore expected side effects, and with significant advantages.

Urea is added during the boiler combustion process. While ammonia in water has a characteristic odor and is classified as a hazardous material, urea is an odorless, water-soluble salt, which is not classified as a hazardous material. The present process includes a urea and waste water mixing and injection system for handling the urea and waste products.

The present invention is a system and process for improving the combustion of fuel oil in boilers, internal combustion engines, and/or turbines, using: (1) dual homogenization of oil and water; (2) recovery of heat from, and injection and use of, boiler waste water in the homogenization system; (3) mixing of urea and boiler waste water, and injection into the boiler exhaust gas stream. The system and process of the present invention employs cavitation at several sequential stages in primary and secondary dual homogenization subsystems to homogenize a fuel oil and water emulsion in order to break up oil particles and reduce droplet size of the fuel oil, thereby increasing the surface area available for burning and improving combustion.

The present homogenization system and process further recovers available excess heat from boiler waste water, thereby increasing the overall efficiency of the steam generating system, and injects the waste water into the homogenization system, thereby conserving water and reducing costs. Cost reduction includes savings from lower waste water treatment costs. Boiler waste water is injected into the fuel by volume, and the pH of the boiler waste water dilutes the sulfur trioxide ($SO_3$) byproduct during combustion. The volume of injection is controlled to reduce nitrous oxide (NOx) from the process.

Finally, the present system and process includes mixing urea into a portion of the waste water for injection into boiler exhaust gases, which neutralizes and reduces emissions of nitrogen oxides (NOx) and sulfur oxides. This also occurs a second time during the combustion cycle. End results of the invention include cleaner boiler operations and systems that are less susceptible than conventional systems or processes to corrosion and wear, a reduced level of emissions, and decreased fuel consumption by the boiler and/or internal combustion system. Boiler and plant maintenance requirements are thus also reduced.

BRIEF SUMMARY OF THE INVENTION

The present invention includes an efficient power plant system for homogenizing recycled oil or fuel oil, comprising:

(a) a fuel service subsystem comprising a boiler;

(b) a dual subsystem for homogeneously intermixing boiler waste water and fuel oil, the dual homogenization subsystem comprising a primary and a secondary homogenization subsystem, the primary and secondary homogenization subsystems, which are substantially similar to one another, each comprising at least one low pressure homogenization chamber preceding at least one high pressure homogenization subsystem, with a compensating valve preceding each homogenization chamber;

(c) a boiler blow down water and heat recovery subsystem; and (d) a urea and waste water mixing and injection subsystem;

wherein the fuel service subsystem leads to the dual homogenization subsystem, boiler blow down water from the boiler blow down water and heat recovery subsystem empties into the dual homogenization subsystem, and urea and wastewater from the urea and waste water mixing and injection subsystem flow into the boiler exhaust gas stream.

Also included in the present invention is a process for improving the combustion of fuel oil in a boiler, which includes the steps of:

(a) heating water in a boiler and producing steam;

(b) homogeneously intermixing boiler blow down water and the fuel oil from the boiler in a dual homogenization subsystem, by subjecting the boiler blow down water and fuel oil to low pressure in a homogenization chamber, followed by subjecting the boiler blow down water and fuel oil to high pressure in a homogenization chamber, while inducing cavitation in the homogenization chambers;

(c) injecting boiler waste water into a boiler exhaust gas stream, mixing waste water and urea for injection into the exhaust gas stream; and (d) recovering heat from boiler blow down water for the dual homogenization subsystem.

The present invention, with its controlled injection of boiler waste water and urea, provides many advantages, including the following:

1) Reduces nitrogen oxides (NOx);
2) Reduces particulate emissions from the homogenization process;
3) Reduces fuel consumption, which reduces dependency on crude oil from other countries;
4) Reduces requirements for combustion air;
5) Reduces opacity;
6) Reduces soot blowing from the boiler;
7) Reduces sulfur trioxide ($SO_3$);
8) Reduces carbon monoxide (CO) output;
9) Reduces carbon dioxide ($CO_2$) generation;
10) Increases flame temperature;
11) Reduces the amount of required maintenance of the system;
12) Heat is recovered from boiler blow down water;
13) Increases boiler and plant efficiency;
14) Combustion requires less residence time in a combustion chamber (furnace);
15) Eliminates the build-up of vanadium, an undesirable by-product, on the fireside of boiler;
16) Optimizes heat transfer;

17) Less hazardous material side-products to dispose of; and

18) Reduces any contribution by the subject plant to global warming or acid rain, which can be a by-product of the homogenization process.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
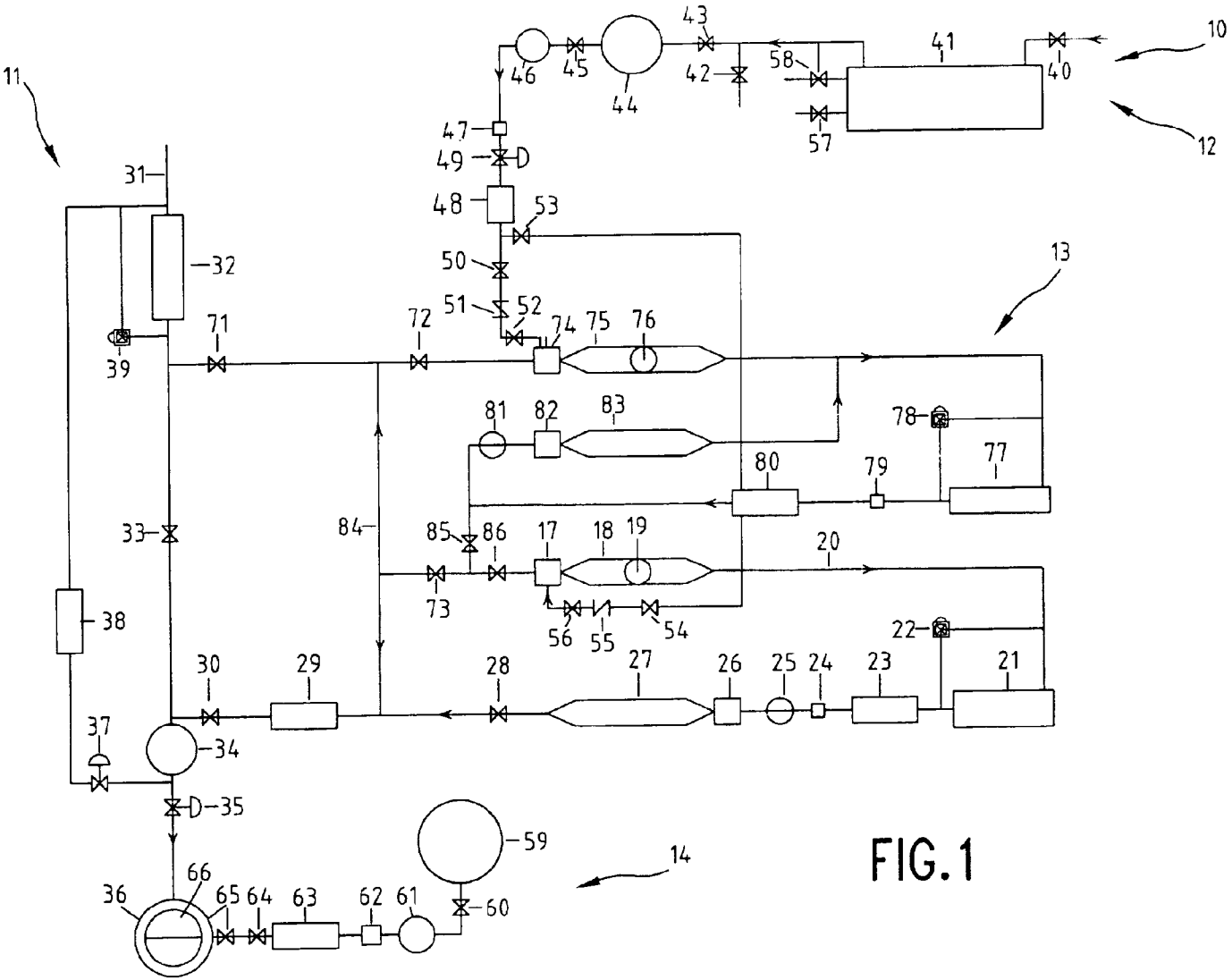
FIG. 1 is a process flowchart showing an entire system according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

FIG. 1 shows an entire power plant system 10 according to the present invention for homogenizing recycled oil and/or fuel oil, particularly #2, #4, #5, #6, and Bunker "C" fuel oils. The system 10 and process herein involves four main subsystems: (1) a basic, existing fuel service subsystem 11; (2) a boiler blow down water and heat recovery subsystem 12; (3) a dual homogenization subsystem 13; and (4) a urea and waste water mixing and injection subsystem 14. Generally, fuel oil is transmitted through the fuel service subsystem 11 by means of a fuel service pump 32. The fuel flows through a heater 34, where it is heated, to a boiler 36, where steam is produced.

Continuing with FIG. 1, an inlet valve 71 to the dual homogenization subsystem 13 and an outlet valve 30 from the dual homogenization subsystem are located between the fuel pump 32 and the fuel heater 34. Fuel may be routed by means of these valves 71, 30 through the dual homogenization subsystem 13. Fuel is mixed with boiler blow down water within the dual homogenization subsystem, and cavitated in order to reduce its oil droplet size and improve combustion. Oil droplet size is preferably maintained within a diameter of between about four (4) and seven (7) microns, with 100% disbursement.

The dual homogenization subsystem 13 includes a primary and a secondary homogenization subsystem, 13*a*, 13*b*, which are substantially duplicates of one another. Each includes two homogenization chambers. The primary and secondary homogenization subsystems 13*a*, 13*b* are in series in the preferred system of FIG. 1, but could alternatively be in parallel. The fuel undergoes cavitation in four successive homogenization chambers 75, 83, 18, 27 before returning to the fuel service subsystem 11 and the fuel heater 34.

Continuing to refer to FIG. 1, boiler waste water passes through a heat exchanger 41 before being injected into the primary or secondary homogenization subsystem, or alternatively, the urea-water mixing tank 59. The urea-water mixture is injected into the boiler exhaust gas stream 66. The entire process is regulated by means of valves, sensors, and servomotors, allowing use of the primary homogenization subsystem 13*a* only, the secondary 13*b* only, or both, and further allowing control of the boiler blow down water heat recovery subsystem and the urea-water subsystem, ensuring that fuel continues to flow to the boiler. The heat recovered from boiler blow down water can be in the order of about 2% reduction in fuel consumption or higher, depending on boiler capacity.

The unique homogenization subsystem of the present invention employs in line cavitation by reducing fuel pressure through an automatically controlled hydraulic compensating valve that creates and controls cavitation. The mechanical shearing forces, which are believed to be between about 12,000 and 15,000 pounds, of cavitation shear, shred and tear hydrocarbon chains, asphaultines, and substances in the cavitation "vortex" to less than about seven (7) microns in diameter. An important aspect of the present invention is maintaining homogenization chamber pressure at a predetermined value, plus or minus about two (2) psig at the designated pressure, temperature, flow rate and/or rate of change. Without meaning to be bound by theory, it is believed that maintaining a constant pressure in the homogenization chamber is critical in controlling water droplet size, supplying a homogeneous mixture to the boiler burner (gun), internal combustion engine, or turbine injector.

Cavitation is preferably carried out by an extreme reduction in line pressure, which increases velocity. This creates gaseous bubbles, expanding and collapsing them within about 18 to 20 inches of inception. All cavitation is created and completed within the dual homogenization subsystem 13.

As used herein, "fuel oil" preferably includes #2, #4, #5, #6, and Bunker "C" fuels, as well as recycled oil.

As used herein, the word "emulsion" generally means a homogeneous mixture of fuel to water by volume.

As used herein, by "boiler blow down water" is meant the water that is bled from the steam drum to maintain the conductivity of the pool of boiler water before evaporation. Potable water is constantly supplied to make up for the volume of blow down and leaks throughout the steam system. The potable make-up boiler feed water is passed through the boiler blow down heat exchanger 41, recovering the heretofore wasted heat, en route to feed water deaerating heater. At this point, the water is raised to a predetermined temperature before entering boiler feed water pump suction.

As used herein, "urea" includes urea amines, such as ethanolamine, triethylamine, and melamine; and urea condensates; as well as the products of hydrolysis of urea, including ammonium carbonate and bicarbonate; and polymerization of urea, including biuret; and any other commercial forms of urea and its by-products. Urea is normally available as an aqueous solution, though it can be found in dry form. When an aqueous urea solution is heated, it hydrolyzes, forming ammonium carbonate, bicarbonate, and/or carbamate. Further heating of these products results in the formation of ammonia, carbon dioxide, and water as steam. Urea decomposes when heating is not properly controlled, leaving a thick residue that can clog equipment.

Figure 2:
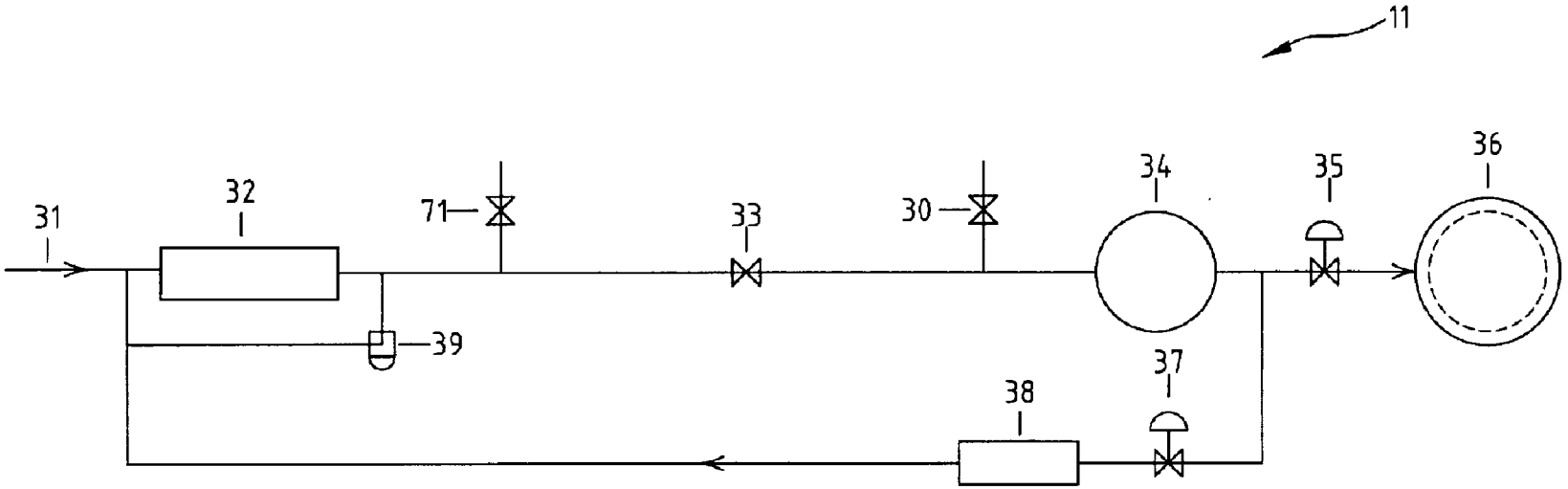
FIG. 2 is a flowchart of the basic power plant fuel service subsystem from FIG. 1.

Turning to FIG. 2, in the basic power plant fuel service subsystem 11 also shown in FIG. 1, a fuel supply system pump 32 suctions from a service tank (not shown) through a suction line 31. Fuel is then discharged at a predetermined pressure past a discharge relief valve 39, through a fuel homogenization system bypass valve 33 and a fuel oil heater 34, via a control valve 35 to the boiler 36. If the fuel service subsystem 11 is designed with a circulating system, as shown in FIG. 2, a circulating oil control valve 37 controls the recirculating oil flow through a flow sensor 38 back to the service pump suction line 31 and the fuel service pump 32. An inlet valve 71 to the homogenization subsystem and outlet valve 30 from the homogenization subsystem are located in succession between the fuel pump 32 and fuel heater 34.

Figure 3:
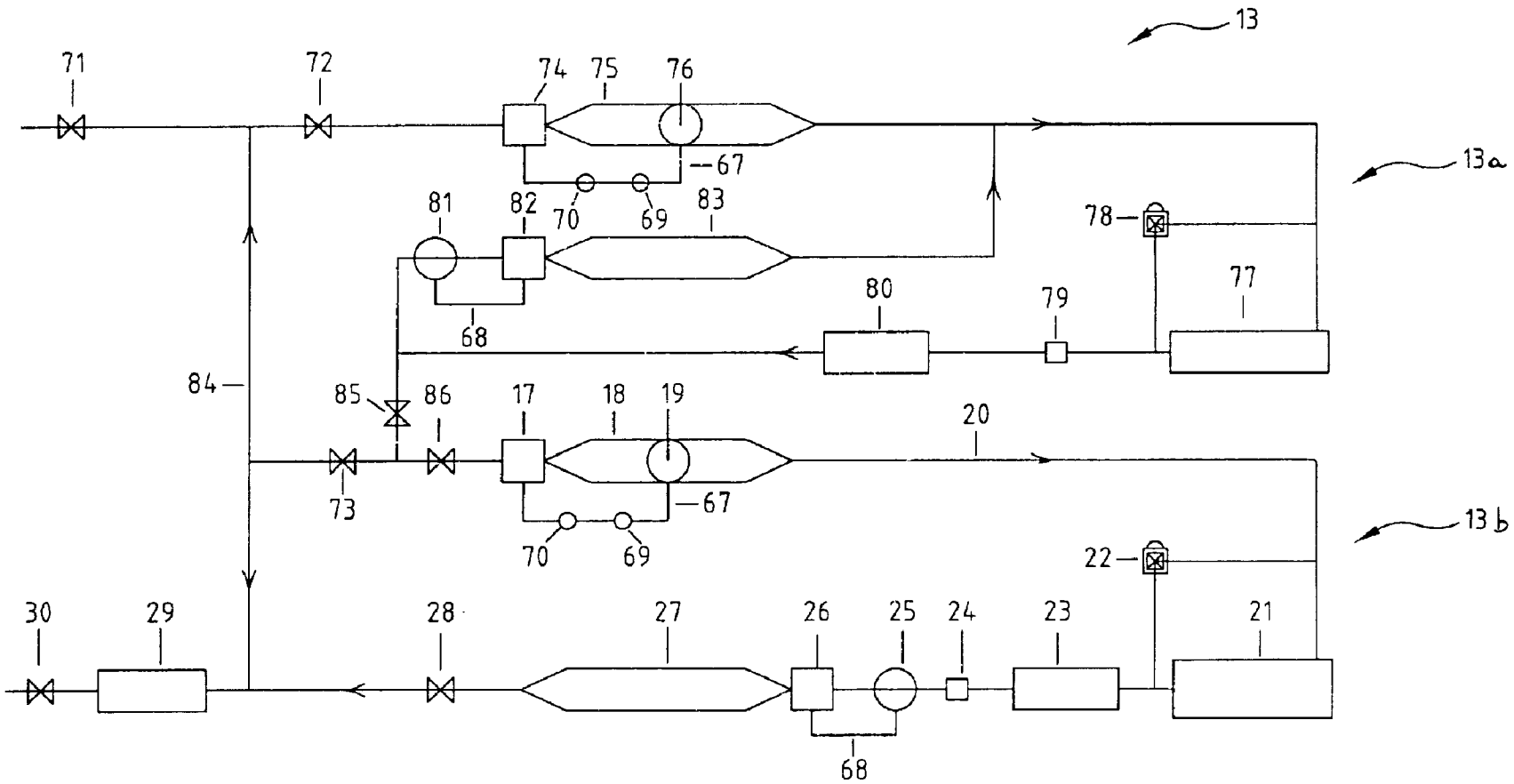
FIG. 3 is a flowchart showing the dual homogenization subsystem according to FIG. 1.

Referring to FIG. 3, which illustrates the dual homogenization subsystem 13 also shown in FIG. 1, fuel at the normal operating pressure and temperature of the power plant system enters the dual homogenization subsystem through the system inlet valve 71. Fuel continues flowing through the primary subsystem inlet valve 72. Boiler blow down water is injected through a water injection stop valve 52 into a primary low pressure compensating valve 74, taking advantage of strong cavitational forces to homogenize the water into the fuel oil and control water droplet size. Droplet size is preferably maintained at between about four (4) and seven (7) microns in diameter. As fuel passes through the automatically controlled low pressure compensating valve 74, pressure is reduced (preferably to about 30 psig). This creates controlled cavitation that reduces asphaltines, hydrocarbons and other particles in the fuel oil, preferably to a diameter of less than about seven microns. The primary low pressure homogenization chamber 75 is designed to prevent the cavitation envelope from contacting metal piping at any time, except for partial contact at the inception of cavitation. This is accomplished by designing the primary low pressure homogenization chamber 75 to be sufficiently long and with a large enough diameter to prevent cavitation, and therefore damage, to the contact piping. Compensating valves (74, 82, 17, 26) leading into each homogenization chamber (75, 83, 18, 27) reduce pressure in the line and increase velocity of the fluid sufficiently to induce cavitation. All compensating valve oil related material is manufactured of special materials and hardened to withstand abrasion and preliminary forces of cavitation. Cavitational gaseous bubbles are formed, expanded and collapsed within a distance of about 18 to 20 inches in the homogenization chamber 75.

A servomotor 76 in the homogenization chamber 75 transmits the homogenization chamber fluid hydraulically through hydraulic line 67 to the low pressure compensating valve 74, which is normally open. The fluid moves the valve 74 to a closed position to maintain homogenization chamber pressure, plus or minus two (2) pounds, at any given flow rate and/or rate of change. A low pressure (stop) switch 69 and a high pressure (start) switch 70 are located in the hydraulic line 67 from the servomotor 76 and low pressure compensating valve 74 that will automatically start the homogenization subsystem when pressure in the homogenization chamber 75 increases to 45 psig when the system is placed into operation. Pressure is automatically maintained in the low pressure homogenization chamber 75 at any predetermined pressure, and the percentage of boiler blow down water injected into fuel and percentage of urea to boiler waste water mixture are controlled, along with its injection into combustion gas. The low pressure switch 69 will automatically stop the homogenization subsystem if the homogenization chamber 75 pressure is reduced, preferably to 10 psig. Homogenized oil/water now flows, preferably at 30 psig, to the primary positive displacement pump 77, which increases fuel pressure to 300 psig, in the discharge line. The homogenized oil/water flows past a high pressure relief valve 78 and a high pressure switch 79 that will sound an alarm and signal the burner management system in the event of pump failure, to switch from homogenized fuel oil to regular fuel oil, allowing a supply of sufficient combustion air to keep the stack clear and close the solenoid operated ball valves 50, 54 in the water system, preventing oil from entering the water system. Fuel then flows through a flow sensor 80 that, in conjunction with the fuel flow sensor 29 to the boiler 36, controls primary pump discharge volume at 110% of actual fuel being burned, with the use of a variable frequency controller and variable drive motor. From there, fuel flows past a valve 85 to the secondary homogenization subsystem, and to a high pressure servo motor 81 and high pressure compensating valve 82.

Continuing with FIG. 3, the servomotor 81 is installed in the fuel discharge line to maintain pressure at 300 psig, transmitting line pressure hydraulically to the primary high pressure compensating valve's 82. As pressure increases above 300 psig, it forces the high pressure compensating valve 82 in the opening direction (valve is normally closed) to maintain a discharge pressure at 300 psig. The primary high pressure compensating valve 82 reduces the pressure from 300 psig to 30 psig as it returns the 10% excess oil to the primary positive displacement pump 77, creating a second cavitational process in the high pressure homogenization chamber 83, which aids in reducing substantially all of the particles in the fuel oil to less than seven microns. Homogenized oil at 30 psig flows to the primary pump 77.

Referring still to FIGS. 1 and 3, a secondary homogenization chamber functions in the same way as the primary homogenization subsystem 13*a*. Oil from the primary subsystem 13*a* passes through valves 85, 86 to the low pressure compensating valve 17 of the secondary subsystem 13*b*. At this point, boiler blow down water is injected through valve 56 and homogenized into the fuel oil, as in the primary subsystem. The secondary subsystem low pressure compensating valve 17 reduces pressure from 300 psig to 30 psig creating a third cavitational process in the secondary subsystem low pressure homogenization chamber 18. A servomotor 19 installed in the secondary low pressure homogenization chamber 18 transmits its pressure hydraulically through line 67 to the secondary subsystem's low pressure compensating valve 17. As pressure increases in the homogenization chamber 18, it causes the secondary low pressure compensating valve 17, which is normally open, to move in the closing direction. The servomotor 19 and secondary low pressure compensating valve 17 will maintain homogenization chamber 18 pressure, plus or minus two (2) pounds, at any flow rate and/or temperature change at any flow rate and/or rate of change.

Homogenized water and oil, preferably at 30 psig, flows through suction line 20 to the positive displacement pump 21. The pump 21 raises the pressure from 30 psig to 600 psig. Fuel oil then flows past a discharge relief valve 22 and a high pressure switch 24 that will sound an alarm and signal a Burner Management System to switch from homogenized fuel to regular fuel in the event of pump failure, thus supplying sufficient combustion air to keep the stack clear and close the solenoid operated ball valves 50 and 54, and preventing oil from entering the water system. Fuel continues through a flow sensor 23, which in conjunction with the fuel flow sensor 29 to the boiler 36 and a variable frequency controller (not shown) and variable drive motor (not shown) control the secondary pump 21 speed to deliver 110% flow rate of actual fuel being burned. From there, fuel flows to the secondary high pressure servo motor 25 and the secondary system high pressure compensating valve 26 (normally closed). As pressure in the discharge line increases above 600 psig, the servomotor 25 transmits its signal hydraulically through line 68 to the secondary high pressure compensating valve 26, moving the compensating valve 26 in a downward direction; opening the secondary high pressure compensating valve 26 in response to servomotor 25 signal reduces the 600 psig oil to system operating pressure, thereby creating a fourth cavitational process in the secondary high pressure homogenization chamber 27. The additional cavitational processes further reduce oil droplet size, enhancing combustion, creating secondary atomization, and increasing flame burnout temperature. Homogenized water and oil continue back to the basic oil supply system at the original pressure and temperature through a secondary outlet valve 28, through the fuel flow sensor 29, and homogenization subsystem outlet valve 30. The 10% excess fuel oil line 84 recirculates to the primary homogenization subsystem.

Figure 4:
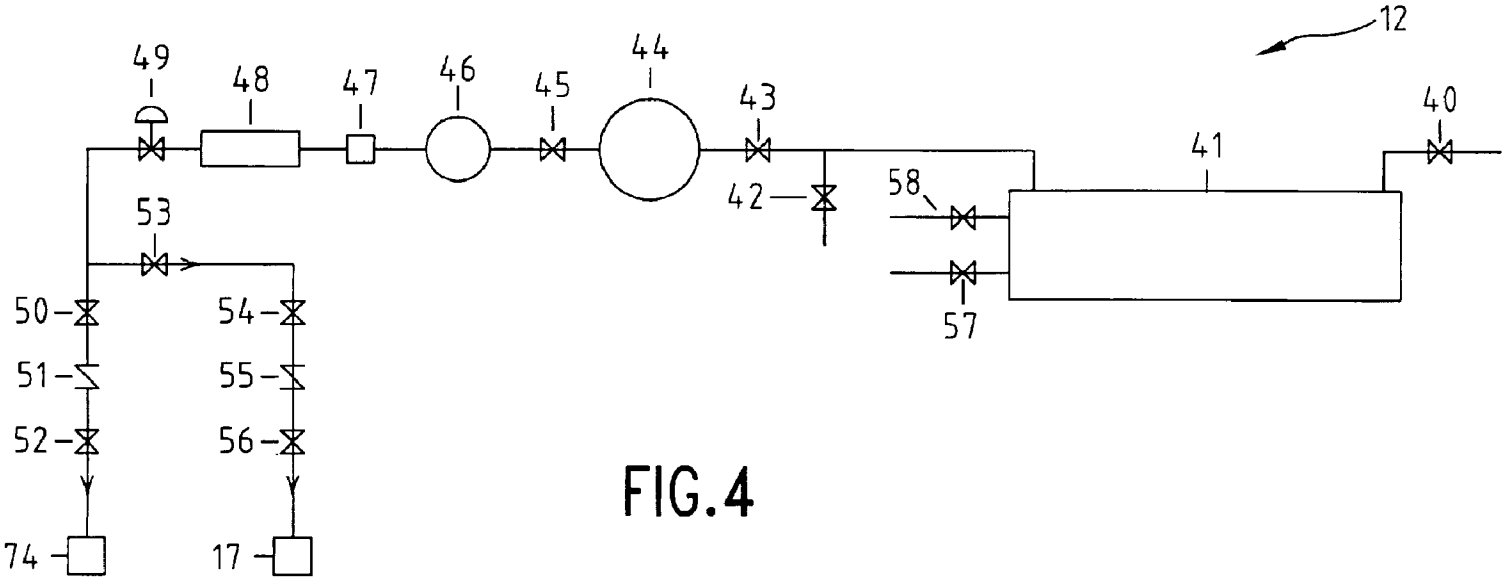
FIG. 4 is a flowchart showing the waste water recovery and injection subsystem, with heat recovery, from FIG. 1.

Turning to FIG. 4, which illustrates the waste water recovery and injection subsystem 14 also shown in FIG. 1, boiler blow down water is used to control the conductivity of the boiler water. The boiler water is conductive as a result of salt and metallic impurities that build up in the boiler water as steam evaporates. The boiler waste water passes through the heat recovery inlet valve 40 to a heat exchanger 41, where its temperature is reduced to 125° F. or less, using boiler make-up water as a coolant. The boiler make up water circulates through the heat exchanger by way of the system's condensate inlet valve 57 and outlet valve 58. Heat is thereby transferred from boiler waste water to boiler feed water. Waste water may be directed through the solenoid filling valve 43 to the boiler blow down injection water tank 44. From there, it flows through a suction valve 45 to the water injection pump 46, operating at 120 psig, and from there through a pressure switch 47 that will sound an alarm and signal Burner Management System to switch from homogenized fuel to regular fuel, in the event of water injection pump 46 failure. Deactivation of the pressure switch 47 will also close the solenoid operated ball valves 50, 54, preventing water from entering the homogenization subsystem.

Ball valves 50, 54 prevent fuel oil from entering the water system in the event of leakage through non return valves 51, 55. From the pressure switch, water flows through a flow sensor 48 and through an injection water control valve 49. This signals a microprocessor, which can be remote from the system, indicating the volume of injected water through solenoid operated ball valve 50, non-return valve 51, and stop valve 52 into the primary subsystem low pressure compensating valve 74. Boiler blow down injection water may also flow through a diversion valve 53 to the secondary homogenization subsystem through a similar solenoid operated ball valve 54, non return valve 55 and stop valve 56, to the secondary subsystem low pressure compensating valve 17. Waste water from the heat exchanger 41 may also be directed through the heat recovery outlet valve 42 to the urea mixing tank 59, and to the water treatment tank (not shown) for disposal of excess boiler blow down water that is not used for injection into fuel oil and/or dilution of urea.

Figure 5:
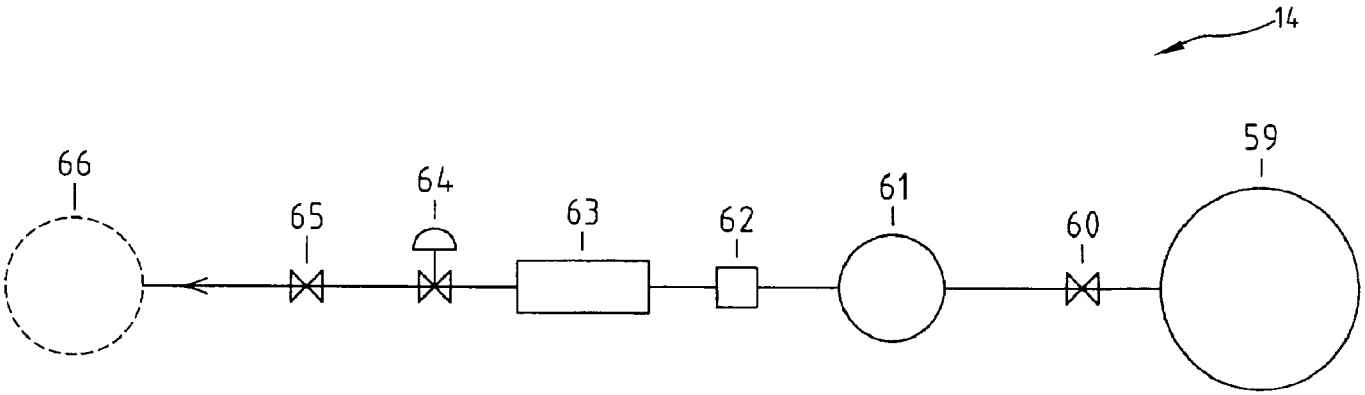
FIG. 5 is a flowchart showing the homogenization urea and boiler blow down water subsystem according to FIG. 1.

Turning to FIG. 5, which illustrates the urea and waste water mixing/injection subsystem shown in FIG. 1, urea is dissolved with boiler blow down water in a mixing tank 59. A suction valve 60 allows the urea and boiler blow down water to enter the injection pump 61, which increases its operating pressure to 150 psig, then through the pressure switch 62, which sounds an alarm in the event of pump 61 failure. In this case, pump 61 failure will not affect combustion or stack opacity. In response to the fuel flow sensor 29, the microprocessor (which can be physically remote from the system) sends a signal to I/P (preferably a 4 to 20 ma signal to a pneumatic control valve), which in turn controls a (3 to 15 psig) pneumatic signal to control valve 64, controlling the flow through the flow sensor 63. The boiler blow down and urea flow sensor 63 sends its signal to the microprocessor as a feed back signal in response to the microprocessor's signal to the control valve 64 to control a predetermined volume of urea and boiler blow down water injected into exhaust gases 66.

Thus, a preferred, automatic system according to the present invention further comprises a positive fuel homogenization pump with speed and pressure controls; a water injection collection vessel, water pump, pressure controls, and an injection control valve; and a microprocessor having memory and a microprocessor control system, the microprocessor being connected to the system. In a preferred embodiment, the system's variable drive controllers and flow sensors input to the microprocessor, and the microprocessor signals the primary and secondary motor control pumps and I/P. In a preferred embodiment, the homogenization subsystem further comprises a pressure sensor connected to each compensating valve for automatically controlling the compensating valve, and a primary and a secondary motor control pump, which are automatically controlled by the microprocessor. In this embodiment, the urea and waste water mixing and injection subsystem comprises a urea/waste water mixing vessel, automatic dispensing controls for dispensing urea into the mixing vessel, and an automatic control valve for controlling the volume of boiler blow down water flowing into the mixing vessel. The fuel oil is preferably #2, #4, #5, #6, Bunker "C" fuel, or recycled oil. The primary and secondary homogenization subsystems are in series or in parallel.

Turning again to FIG. 1, the fuel flow sensor 29 emits its signal to the microprocessor, which is programmed to control the percentage of boiler blow down water injection into fuel oil, the percentage of urea and boiler blow down water to the mixing tank 59, and the percentage of urea and boiler blow down water injection to exhaust gas relative to the volume of fuel being burned. The microprocessor sends a signal (preferably 4 to 20 ma) to the I/P that controls a 3 to 15 psig pneumatic signal to the injection water control valve 49. This controls the volume of water injection through valves 52 and/or 56, and to the control valve 64 controlling the injection of urea and boiler blow down water by volume to exhaust gases. As described above, in plant operating fuel oil systems that have a continual circulation of fuel oil during operation, the circulating oil line that normally terminates in the storage tank is diverted through a control valve 37 and fuel flow sensor 38 to the fuel service pump 32. The sum of the fuel flow sensor 29 minus the circulating oil flow sensor 38 controls the percentage of boiler blow down water (by volume) injection into the homogenization subsystem through valves 52 and 56, the volume of urea and boiler blow down mixture to the mixing tank 59, and the control valve 64 controlling the volume of mixture into exhaust gases relative to oil being burned.

Referring again to FIG. 1, the several valves allow operation of the primary and secondary homogenization subsystems combined, or separately. To operate the primary subsystem 13*a* only, the homogenization subsystem inlet valve 71, the primary subsystem inlet valve 72, the primary discharge valve 85 to the secondary subsystem 13*b*, the inlet valve 73 to the secondary subsystem from the circulating loop, the outlet valve 30 from the homogenization subsystem, and the water injection stop valve 52 are opened, and the secondary subsystem inlet valve 86, secondary subsystem discharge valve 28, and homogenization subsystem bypass valve 33 are closed. The primary subsystem high pressure compensating flow valve 82 will then be adjusted to the plant's fuel operating pressure.

To operate only the secondary subsystem 13*b*, homogenization subsystem inlet valve 71, the inlet valve to the secondary subsystem from circulating loop 73, the secondary subsystem inlet valve 86, secondary subsystem discharge valve 28, outlet valve 30 from the homogenization subsystem, and water injection stop valve 56 to the secondary subsystem are open. The primary subsystem inlet valve 72, the primary discharge valve 85 to the secondary subsystem, the homogenization subsystem bypass valve 33, and the water injection stop valve 52 to the primary subsystem are closed. The combined primary and secondary subsystems 13*a*, 13*b* may be operated by opening homogenization subsystem inlet valve 71, the primary subsystem inlet valve 72, the primary discharge valve 85 to the secondary subsystem, the secondary subsystem inlet valve 86, secondary subsystem discharge valve 28, outlet valve from the homogenization subsystem 30, and water injection stop valve 56 to the secondary subsystem. Homogenization subsystem bypass valve 33, and the water injection stop valve 52 to the primary subsystem 13*a* are then closed.

In the event of failure of either the primary or the secondary subsystem pumps 77, 21, or both primary and secondary subsystem pumps 77, 21, or the water injection pump 46, pump failure will not interrupt fuel oil flow to the burner. In the case of failure of homogenization pump 77, 21, fuel oil will flow through the homogenization subsystem inlet valve 71 through the circulating oil 84 line and homogenization subsystem outlet valve 30, to the fuel heater 34 and on to the boiler 36. The water injection valves 50, 54 will automatically close on failure of homogenization pump 77, 21 or injection pump 46 failure.

A process according to the present invention for improving the combustion of fuel oil in a boiler, comprises the steps of:

(a) heating water in a boiler 36 and producing steam;

(b) homogeneously intermixing-boiler blow down water and the fuel oil from the boiler in a dual homogenization subsystem 13, by subjecting the boiler blow down water and fuel oil to low pressure in a homogenization chamber, followed by subjecting the boiler blow down water and fuel oil to high pressure in a homogenization chamber, while inducing cavitation in the homogenization chambers 75, 83, 18, 27;

(c) injecting boiler waste water into a boiler exhaust gas stream 66, mixing waste water and urea for injection into the exhaust gas stream 66; and (d) recovering heat from boiler blow down water for the dual homogenization subsystem 13.

Preferably, in Step b, the fuel oil is dispersed into microdroplets, the majority of which have a diameter of between about four and seven microns each. Water and fuel oil from the boiler 36 preferably empties into the dual homogenization subsystem 13, boiler blow down water from the boiler blow down water and heat recovery subsystem 12 empties into the dual homogenization subsystem 13, and urea and waste water from the urea and waste water mixing and injection subsystem 14 is injected into the boiler exhaust gas stream 66.

A preferred process herein further includes the step of mixing urea and wastewater in a urea/waste water mixing vessel 59, and injecting it in prescribed amounts into the boiler exhaust stream 66; the step of automatically dispensing urea and boiler blow down water in prescribed amounts into the urea/waste water mixing vessel 59; and the step of controlling with a pre-programmed microprocessor the amount of boiler blow down water injected into the fuel oil in the homogenization subsystem 13, the amounts of urea and boiler blow down water entering the urea/waste water mixing vessel 59, and the amount of urea and boiler blow down water injected into the boiler exhaust gas stream 66, relative to the volume of fuel oil being burned. This preferred process further includes the step of emitting a signal from the microprocessor to an I/P, which in turn signals an injection water control valve 49, which controls the volume of water injected through a water injection stop valve 52/56, and a urea and boiler blow down injection control valve control 64 for controlling the injection of urea and boiler blow down water by volume to boiler exhaust gases 66.

The process employed in the system described above uses cavitation to reduce oil particle sizes and the size of water droplets that are used as a vehicle of combustion. Vapor from the micro-explosions of water droplets that break up oil droplets to a larger burning area removes vanadium build up from the fireside of the boiler during operation. Cavitation is induced and controlled using its extreme forces to reduce asphaltines, hydrocarbons and other particles in oil to less than about seven to ten microns. The homogenization chamber is designed to engulf the cavitation envelope, preventing contact with metal piping. During cavitation gaseous bubbles are formed, expanded and collapsed within 18 to 20 inches from inception. Boiler waste water with a pH of 11.5 is injected at the inception of cavitation, using cavitational forces to control water droplet sizes at four (4) to seven (7) microns with complete disbursement as a vehicle to improve and increase combustion temperature.

The use of boiler blow down water in the present system and process to dissolve urea has several advantages, including: 1) water is free; 2) the boiler waste water would otherwise have to be treated before disposal, so costs are reduced; 3) $SO_3$ is further reduced, plus the reduction during combustion allows control to a level unattainable with conventional systems; 4) use of urea further reduces $NO_x$, in addition to the reduction during combustion that was unattainable in the past using conventional systems; 5) approximately 20% less combustion air is required; which raises combustion temperature above the melting point of vanadium deposit, and reduces or eliminates vanadium build up on fireside of boiler; 6) steam from the micro-explosion of water droplets actually removes vanadium build-up; boiler fireside is kept clean, providing optimum heat transfer; and 7) maintenance requirements are reduced.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. From the foregoing it can be realized that the described device of the present invention may be easily and conveniently utilized. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

BRIEF LIST OF REFERENCE NUMBERS USED IN THE DRAWINGS

10 Plant system
11 Fuel service subsystem
12 Boiler blow down water and heat recovery subsystem
13 Dual homogenization subsystem (primary 13*a*, secondary 13*b*)
14 Urea and waste water mixing and injection subsystem
17 Secondary low pressure compensating valve
18 Secondary low pressure homogenization chamber
19 Secondary servomotor to low pressure compensating valve
20 Secondary homogenized oil to pump
21 Secondary pump
22 Secondary pump discharge relief valve
23 Secondary pump discharge flow sensor
24 Secondary pump discharge pressure switch
25 Secondary servo motor to high pressure compensating valve
26 Secondary high pressure compensating valve
27 Secondary high pressure homogenization chamber
28 Secondary discharge valve
29 Fuel flow sensor to boiler or boilers
30 Outlet valve from homogenization system
31 Fuel service pump suction from service tank
32 Fuel service pump
33 Homogenization system bypass valve
34 Fuel oil heater
35 Fuel control valve to boiler
36 Boiler
37 Circulating oil control valve
38 Circulating oil flow sensor
39 Fuel service pump discharge relief valve
40 Boiler blow down water valve
41 Boiler blow down heat exchanger
42 Boiler blow down water valve to waste water tank
43 Solenoid filling valve to water tank
44 Water injection tank
45 Pump suction valve
46 Injection water pump
47 Injection water pump discharge pressure switch
48 Injection water control valve
49 Injection water flow sensor
50 Water injection solenoid operated ball valve
51 Water injection non return valve
52 Water injection stop valve
53 Water injection valve to secondary unit
54 Solenoid operated injection water ball valve
55 Injection water check valve to secondary unit
56 Injection water stop valve
57 Condensate inlet valve
58 Condensate outlet valve
59 Urea and boiler blow down water mixing tank
60 Pump suction valve
61 Urea and boiler blow down water injection pump
62 Urea pump discharge pressure switch
63 Urea and boiler blow down injection flow sensor
64 Urea and boiler blow down injection control valve
65 Urea and boiler blow down injection stop valve
66 Boiler exhaust
67 Hydraulic line, LP servomotor to compensating valve
68 Hydraulic line, HP servomotor to compensating valve
69 Switch, low pressure (stop switch)
70 Switch, high pressure (start switch)
71 Homogenization system inlet valve
72 Inlet valve to primary system
73 Inlet valve to secondary system from circulating loop
74 Primary low pressure compensating valve
75 Primary low pressure homogenization chamber
76 Primary servo motor to low pressure compensating valve
77 Primary pump
78 Primary pump discharge relief valve
79 Primary pump discharge pressure switch
80 Primary pump discharge flow sensor
81 Primary system high pressure servo motor
82 Primary high pressure compensating valve
83 Primary high pressure homogenization chamber
84 Homogenization system circulating oil
85 Primary discharge valve to secondary system
86 Secondary inlet valve

What is claimed is:

1. An efficient power plant system for homogenizing recycled oil or fuel oil, the system comprising:

(a) a fuel service subsystem comprising a boiler;

(b) a dual subsystem for homogeneously intermixing boiler waste water and fuel oil, the dual homogenization subsystem comprising a primary and a secondary homogenization subsystem, the primary and secondary homogenization subsystems, which are substantially similar to one another, each comprising at least one low pressure homogenization chamber preceding at least one high pressure homogenization subsystem, with a compensating valve preceding each homogenization chamber;

(c) a boiler blow down water and heat recovery subsystem; and (d) a urea and waste water mixing and injection subsystem;

wherein the fuel service subsystem leads to the dual homogenization subsystem, boiler blow down water from the boiler blow down water and heat recovery subsystem empties into the dual homogenization subsystem, and urea and wastewater from the urea and waste water mixing and injection subsystem flow into the boiler.

2. A system according to claim 1, further comprising a microprocessor having memory and a microprocessor control system, the microprocessor being connected to the system.

3. A system according to claim 2, further comprising a plurality of system flow sensors and variable drive controllers, which input to the microprocessor.

4. A system according to claim 1, wherein the homogenization subsystem further comprises a pressure sensor connected to each compensating valve for automatically controlling the compensating valve.

5. A system according to claim 3, wherein the homogenization subsystem further comprises a primary and a secondary motor control pump, which are automatically controlled by the microprocessor.

6. A system according to claim 5, further comprising a positive fuel homogenization pump with speed and pressure controls.

7. A system according to claim 5, further comprising a water injection collection vessel, water pump, pressure controls, and an injection control valve.

8. A system according to claim 2, wherein the urea and waste water mixing and injection subsystem comprises a urea/waste water mixing vessel, automatic dispensing controls for dispensing urea into the mixing vessel, and an automatic control valve for controlling the volume of boiler blow down water flowing into the mixing vessel.

9. A system according to claim 8, wherein the fuel oil is #2, #4, #5, #6, Bunker "C" fuel, or recycled oil.

10. A system according to claim 9, wherein the primary and secondary homogenization subsystems are in series or in parallel.

11. A dual homogenization process for improving the combustion of fuel oil in a boiler, comprising the steps of:

(a) heating water in a boiler and producing steam;

(b) automatically homogeneously intermixing fuel oil and blow down water from the boiler in a dual homogenization subsystem, by subjecting the boiler blow down water and fuel oil to low pressure in a homogenization chamber, followed by subjecting the boiler blow down water and fuel oil to high pressure in a homogenization chamber, while inducing cavitation in the homogenization chambers;

(c) injecting boiler waste water into a boiler exhaust gas stream, mixing waste water and urea for injection into the exhaust gas stream; and (d) recovering heat from boiler blow down water for the dual homogenization subsystem.

12. A process according to claim 11, wherein, in Step b, the fuel oil is dispersed into micro-droplets, the majority of which have a diameter of between about four and seven microns each.

13. A process according to claim 11, wherein fuel oil and water from the boiler empties into the dual homogenization subsystem, and boiler blow down water from the boiler blow down water/heat recovery subsystem empties into the dual homogenization subsystem.

14. A process according to claim 11, further comprising the step of mixing urea and wastewater in a urea/waste water mixing vessel, and injecting it in prescribed amounts into the boiler exhaust stream.

15. A process according to claim 14, further comprising the step of automatically dispensing urea and boiler blow down water in prescribed amounts into the urea/waste water mixing vessel.

16. A process according to claim 15, further comprising the step of controlling the amount of boiler blow down water injected into the fuel oil in the homogenization subsystem, the amounts of urea and boiler blow down water entering the urea/waste water mixing vessel, and the amount of urea and boiler blow down water injected into the boiler exhaust gas stream, relative to the volume of fuel oil being burned, by a pre-programmed microprocessor.

17. A process according to claim 16, further comprising the step of emitting a signal from the microprocessor to an I/P, which in turn signals an injection water control valve, which controls the volume of water injected through a water injection stop valve, and a urea and boiler blow down injection control valve control for controlling the injection of urea and boiler blow down water by volume to boiler exhaust gases.

* * * * *